United States Patent [19]

Schroeder

[11] 4,265,361

[45] May 5, 1981

[54] APPARATUS FOR HANDLING WOUND ROLLS OF FIBROUS WEBS

[75] Inventor: Roger A. Schroeder, Green Bay, Wis.

[73] Assignee: American Can Company, Greenwich, Conn.

[21] Appl. No.: 83,525

[22] Filed: Oct. 10, 1979

[51] Int. Cl.[3] ..... B07C 5/36

[52] U.S. Cl. ..... 209/617; 209/912; 198/626

[58] Field of Search ..... 209/617, 912; 198/626; 83/102

[56] References Cited

U.S. PATENT DOCUMENTS

| | | | |
|---|---|---|---|
| 3,454,142 | 7/1969 | Holstein | 198/626 |
| 4,033,862 | 7/1977 | Spencer | 209/617 |

*Primary Examiner*—Allen N. Knowles

*Attorney, Agent, or Firm*—Robert P. Auber; George P. Ziehmer; Harry W. Hargis, III

[57] ABSTRACT

Apparatus for removing trim from ends of elongate rolls, or logs, of paper cut into several short rolls of uniform lengths. The cut logs are transported longitudinally, in side by side disposition, while the short rolls are individually supported by first support members extending between and engaging confronting sides of the rolls, in combination with second support members opposite the first support members and engaging sides of the rolls opposite the sides engaged by the first members. The trim is not engaged or supported by the first and second members, and is permitted to fall away from the logs as they are transported.

16 Claims, 5 Drawing Figures

APPARATUS FOR HANDLING WOUND ROLLS OF FIBROUS WEBS

BACKGROUND OF THE INVENTION

This invention relates to the manufacture of rolls of fibrous webs, and especially to apparatus for removing trim from ends of elongate rolls of tissue which have been cut into short rolls of uniform lengths.

Known apparatus for removing trim from ends of elongate tissue rolls or logs utilize longitudinally extending moving belts and stationary bars that define a travel path for a log that has been cut into short rolls. An opening is provided over which the log is moved longitudinally, and the opening is so shaped and disposed as to allow the smaller trim to fall therethrough while the short rolls pass over the opening. Apparatus of this type has been found to be somewhat inefficient, requiring considerable attention by an operator to ensure that the trim falls through the opening.

Another prior art apparatus comprises cam actuated fingers for grasping and carrying individual short rolls across an opening while not grasping the trim to permit it to drop through an opening. Such an apparatus characteristically has a large number of intricate castings, springs, and small parts contributing to high initial cost and requiring considerable maintenance.

It is a general objective of the present invention to provide improved apparatus for removing trim from tissue logs.

It is a further and more specific objective of the invention to provide improved conveyor means for cut tissue logs that also operates to remove trim therefrom.

SUMMARY OF THE INVENTION

In achievement of the foregoing as well as other objectives and advantages, the invention contemplates an apparatus for handling material of the type comprising elongate wound rolls of fibrous webs cut into several short rolls of predetermined uniform lengths and having end trim in the form of rolls of less than the uniform lengths to be discarded, comprising: means defining a path along which a cut roll may move longitudinally; means for moving said short rolls along said path, including longitudinally driven support elements spaced uniformly along said path in correspondence with the spacing of said short rolls, and positioned to engage and support the latter, said end rolls of trim being moved along said path by said short rolls and not being engaged by said support elements; and means in said path over which each said short roll is moved while engaged as recited, and effective to remove said non-engaged end rolls of trim while said short rolls are retained by said support elements.

The manner in which the objectives and advantages of the invention may best be achieved will be more fully understood from a consideration of the following description, taken in light of the accompanying drawing.

DESCRIPTION OF THE PREFERRED EMBODIMENT

Figure 1:
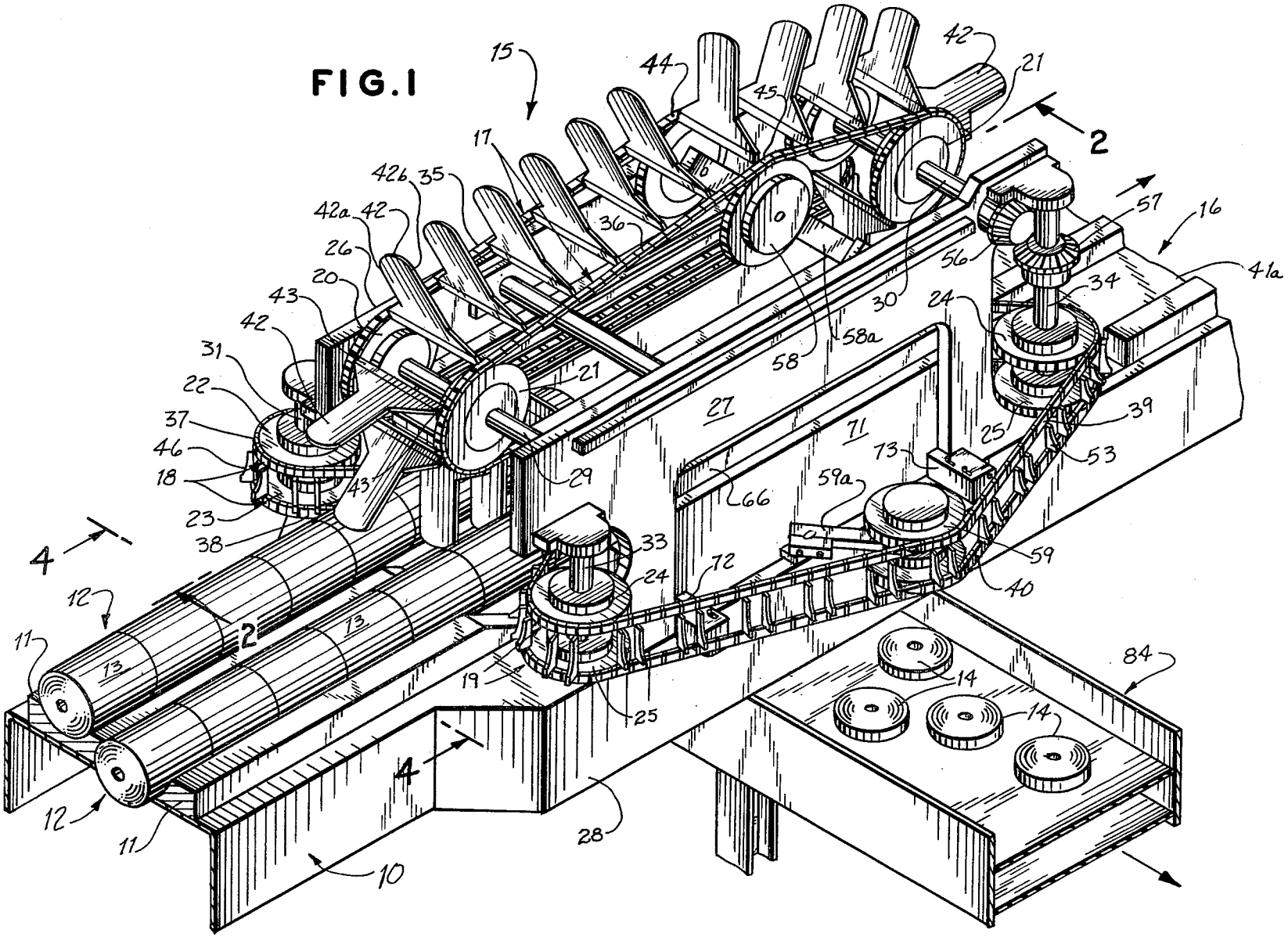
FIG. 1 is a fragmented perspectives showing of apparatus embodying the invention.
Figure 2:
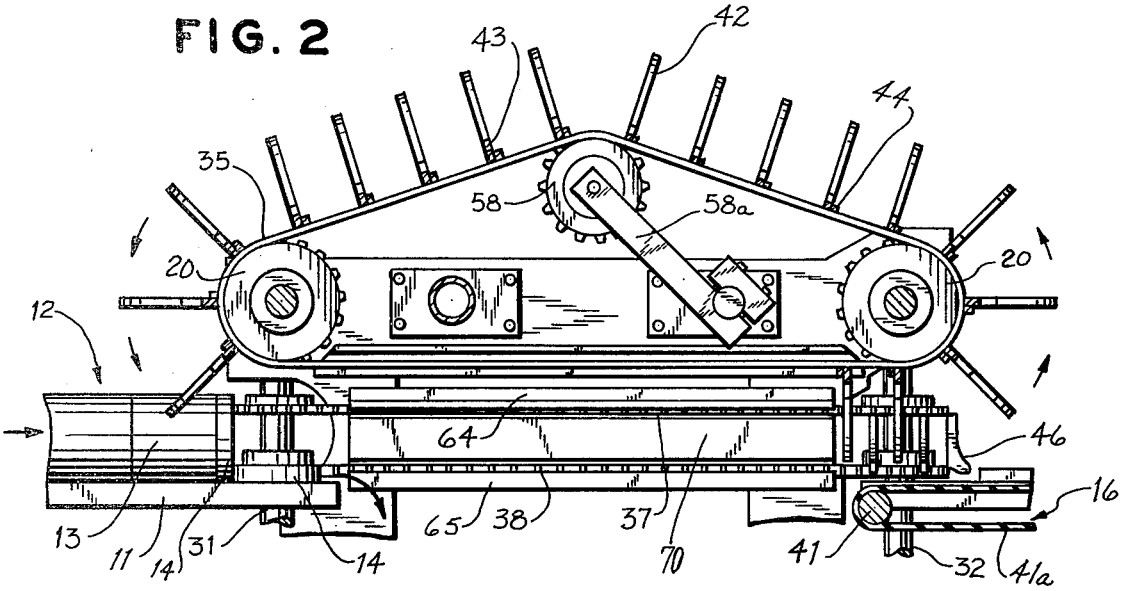
FIG. 2 is a sectional showing, in elevation, of the apparatus seen in FIG. 1, taken generally along line 2—2 and looking in the direction of the arrows applied thereto, and illustrating operational features thereof.

With more detailed reference to the drawing, there is seen in FIG. 1 a portion of the frame 10 of a log saw (not shown) including a pair of parallel support troughs 11 for a pair of logs 12 that have been cut into short rolls 13 of uniform lengths. With reference to FIG. 2, at opposite ends of logs 12 there are rolls of trim, or "cookies", 14 to be disposed of by improved apparatus to be described in detail in what follows and embodying the invention. Troughs 11 project sufficiently beyond the end of the log saw to overlap a travel path defined by a conveyor 15 disposed and adapted to receive the cut logs 12 and transport them longitudinally onto a wrapper conveyor belt 16 spaced therefrom.

In especial accordance with the invention, conveyor 15 comprises three sets of roller chain means 17, 18, and 19 mounted on sets of sprocket wheels: 20, 21; 22, 23; and 24, 25. The sprocket wheels are mounted for rotation on side frames 26 and 27 laterally spaced from one another and supported on a suitable base 28. Sprocket wheels 20, 21 are supported for rotation on spaced, parallel shafts 29, 30 whose axes extend transversely of side frames 26 and 27. Sprocket wheels 22, 23 are supported for rotation on spaced parallel shafts 31, 32 on side frame 26, and whose axes extend perpendicular to and intersect the axes of shafts 29, 30. Sprocket wheels 24, 25 are similarly supported on shafts 33, 34 on side frame 27 and whose axes also extend perpendicular to and intersect the axes of shafts 29, 30. Set of chain means 17 includes a chain 35 partially encircling sprocket wheels 20, and a chain 36 partially encircling sprocket wheels 21. Similarly, chains 37, 38 of set 18, and 39, 40 of set 19, respectively, partially encircle sprocket wheels 22, 23, 24, and 25.

The pair of support troughs 11 extend from a log saw apparatus (not shown) and afford sliding support of cut tissue logs, as seen at 12. The troughs extend between side frames 26 and 27, to a region where they terminate, just beyond shafts 29, 31, and 33. Wrapping conveyor 16 extends between the frames 26 and 27, and includes a pulley 41 (FIGS. 2 and 3) spaced from the end of troughs 11 and a conveyor belt 41*a* extending over the pulley.

Figure 3:
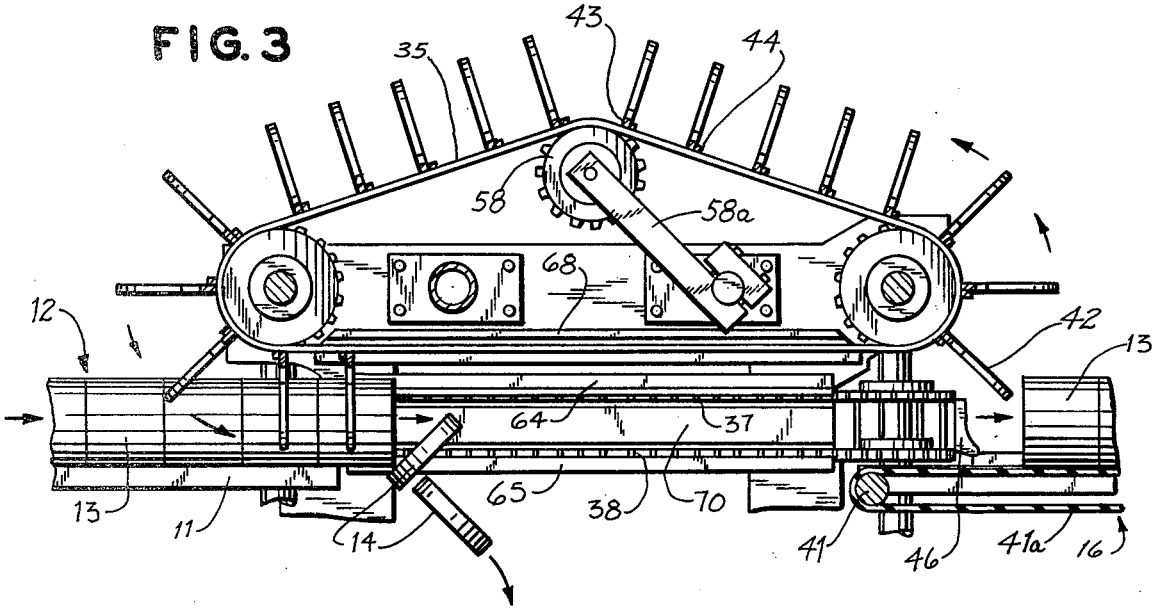
FIG. 3 is a sectional showing similar to FIG. 2, and illustrating further operational features.
Figure 4:
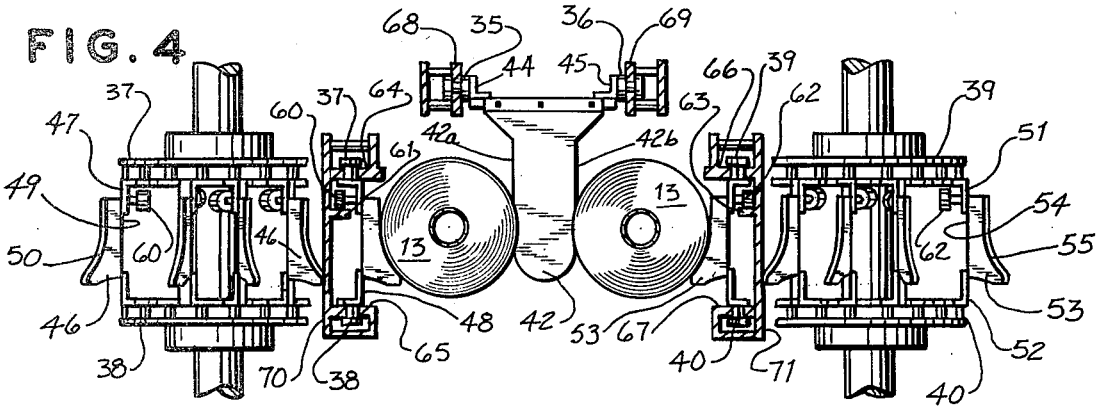
FIG. 4 is a sectional view taken generally along the line 4—4 in FIG. 1, and looking in the direction of arrows applied thereto.

Further to the invention, and with particular reference to FIGS. 2, 3 and 4, a series of uniformly spaced support elements comprising first members such as paddles 42 are supported on chains 35 and 36 by paddle base portions 43 that extend between flanged link portions 44, 45 of chains 35, 36. Pair of chains 37, 38 have flanged links 47, 48 (FIG. 4) that support therebetween a series of additional spaced support elements comprising second members such as vertically extending paired saddles 46 each having a mounting base portion 49 and an arcuate portion 50. The pair of chains 39, 40 have flanged links 51, 52 that support a second series of vertically extending paired saddles 53 each having a mounting base portion 54 and an arcuate portion 55. As is seen to advantage in FIG. 4, the paired saddles 46 and 53 in the region between side frames 26 and 27 are directly opposite one another so that their respective arcuate portions 50 and 55 are in spaced confronting relationship to one another. The paddles 42 are so positioned that the opposite edge portions 42*a*, 42*b* thereof, in the region between side frames 26, 27 are aligned with an imaginary line midway between the saddles of respective pairs 46 and 53 (See FIG. 2).

The sprocket wheels 20, 21, 22, 23, 24, and 25 at the right-hand end of frames 26 and 27, as viewed in FIG. 1, are driven in unison through an arrangement of bevel gears, one pair of which is seen at 56 and 57 keyed to the sprocket wheel shafts as shown, and powered from a single drive means (not shown) of known construction.

Further to the disposition of paddles 42 and saddles 46, 53, in the preferred embodiment, there are 18 paddles and 36 saddles in each series thereof. The chains supporting the paddles and sets of saddles each include mutually confronting sections that are devoid of paddles and saddles, for reasons more fully to be understood from a consideration of operation of the apparatus.

Conveniently, tensions in the several chain sets 17, 18 and 19 are maintained by respective sets of idler sprocket wheels, only two of which are seen at 58 and 59 (FIGS. 1, 2 and 3), and supported by respective adjustable support arms 58*a* and 59*a* on side frames 26 and 27.

With further detailed reference to FIG. 4, the upper flanged links 47 that support saddles 46 include rollers 60 on horizontal axes and retained for travel in a track 61 extending in the direction of travel of chains 37 and 38. Similar rollers 62 on flanged links 51 are retained for travel in a track 63 parallel to and laterally spaced from track 61. Rollers 60 and 62, in cooperation with their respective tracks 61 and 63, provide vertical support for the chain pairs 37, 38 and 39, 40 respectively. Also extending parallel to tracks 61 and 63 are a pair of vertically spaced guide rails 64 and 65 that extend respectively above and below track 61 and through which parallel sections of chains 37 and 38, respectively move along the conveyor travel path. Similar rails 66 and 67 are provided for parallel sections of chains 39 and 40, respectively. Guide rail pairs 64, 65 and 66, 67 are so laterally spaced as to be closer together than the confronting portions of sprockets 22, 23 and 24, 25, whereby the saddles 46 and 53 are, in cooperation with paddle edges 42*a*, 42*b*, urged laterally by lateral displacement of the chain in their guide rails toward a roll 13 to engage and slightly to compress the same. Guide rails 68 and 69 also are parallel to rails 64–67, and are positioned and adapted to retain and support parallel sections of chains 35 and 36 in their longitudinal, roll-supporting travel. Movements of the chains into and out of their respective guide rails is facilitated by suitably contoured ends of the rails.

Track 61 and guide rails 64, 65 are supported on vertical plate 70, and track 63 and guide rails 66, 67 are supported on vertical plate 71. The plates 70 and 71 are adjustably supported on side frames 26 and 27, in confronting spaced relationship to one another, to accomodate handling of rolls 13 of different diameters, for example in a range from about $4\frac{1}{2}$ to about $4\frac{3}{4}$ inches. Conveniently, adjustment of the plates 70, 71 changes the distance between the rails 64, 65 and 66, 67 and between tracks 61 and 63, and repositions the sections of chains 37, 38 and 39, 40 in the rails. Repositioning of the chain sections is compensated by repositioning of idler support arm 59*a* and its opposite, non-visible counterpart (FIG. 1).

Figure 5:
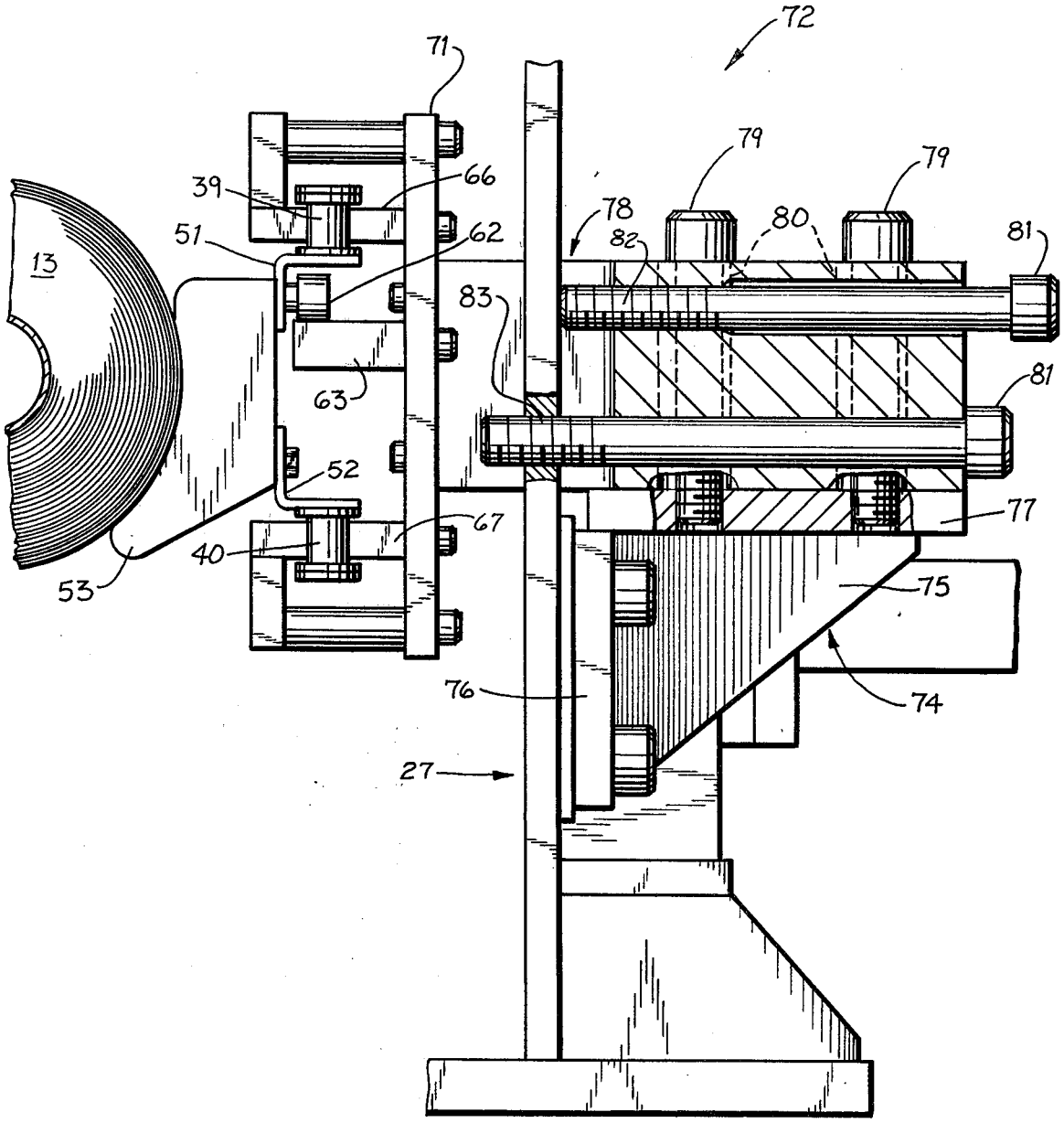
FIG. 5 is an enlarged elevational view of a portion of the apparatus seen in FIG. 1, with parts fragmented or removed for convenience of illustration.

With reference to FIGS. 1 and 5, it is seen that adjustable support of plate 71 is achieved by brackets designated generally by the numerals 72 and 73. Plate 70 is similarly supported, and since brackets 72 and 73 essentially are the same except that upper portions on a side are merely the reverse of one another, only bracket 72 will be described in detail. More particularly, and with more detailed reference to FIG. 5, bracket 72 includes an angle member 74 provided with a brace 75 extending between a vertically extending base 76 bolted to side frame 27 and a horizontally extending tapped portion 77. A generally L-shaped block 78 (see FIG. 1) is supported on tapped portion 77 of member 74 by a pair of screw means or bolts 79 extending throgh slots 80 in block 78 and threaded into tapped portion 77. Another pair of screw means on bolts 81 are provided, the upper one of which extends through tapped portion 82 of block 78 and abuttingly engages side frame 27. The lower one of bolts 81 extends with clearance through block 78 and is threaded into a tapped portion 83 of side frame 27.

To adjust the position of plate 71, for example inwardly, bolts 79 are loosened, and block 78 is repositioned inwardly by first backing out the upper one of bolts 81, followed by turning the lower one of bolts 81 to urge block 78, and plate 71 thereon, inwardly to the desired position. The upper one of bolts 81 is turned again to engage side frame 27, and bolts 79 then are tightened to anchor the block 78. Adjustment of bracket 73 is carried out in the same manner preferably simultaneously with the adjustment of bracket 72. Adjustment for the non-visible brackets for plate 71 is carried out in the same manner. Adjustment of the plate 71 outwardly is achieved by loosening bolts 79, turning the lower one of bolts 81 to urge block 78 outwardly to the desired position, turning the upper one of bolts 81 again to engage side frame 27, followed by tightening bolts 79 to anchor the block.

With further detailed reference to FIG. 1, a conveyor belt 84 extends transversely of an is disposed below the region of conveyor 15, in the region thereof between ends of troughs 11 and wrapper conveyor belt 16. The function of conveyor belt 84 is to receive the rolls of trim 14 as they fall from conveyor 15, and carry them to a suitable disposal area.

In operation of the apparatus, and with particular reference to FIG. 2, logs 12 contemplated by the invention are about 85 inches long, and are cut into eighteen rolls 13, each about $4\frac{1}{2}$ inches in length, leaving a roll of trim 14 at each end about two inches in length. As viewed in FIG. 2, left hand side, a log 12 is being urged along saw trough 11, pushing a leading roll of trim 14 and a lagging roll of trim 14 left from the preceding log. In the illustrated position of log 12, the leading paddle 42, in combination with leading pair of saddles 46, is being moved toward a log engaging position. With reference to FIG. 3, left hand side, the leading paddle 42 and pair of saddles 46, as well as the next succeeding paddle 42 and pair of saddles 46, have engaged the first and second rolls 13, moving the first roll to the edge of trough 11. In such position, the rolls of trim 14 are not engaged by a paddle 42 and saddles 46. Rolls of trim 14 therefore are not supported, and are removed from trough 11 by pushing them off so that they fall freely onto conveyor 84 (FIG. 1). Individual, successive rolls 13 of a log are then carried by conveyor 15 in the manner described, and, as shown in FIG. 2, right hand side, are released as they move onto wrapping conveyor belt 41a. The release of rolls 13 occurs when chains 37, 38 move out of the right hand ends of rails 64, 65 and onto corresponding sprocket wheels 22, 23.

While operation of apparatus has been described in terms of its left hand side as seen looking in the direction of travel of the logs, e.g. FIG. 4, and shown in side elevation in FIGS. 2 and 3 it will be appreciated that operation of the right side is identical thereto. It will further be appreciated that the apparatus may convey one cut log at a time, or it may convey logs of different diameters, as is afforded by the disclosed selective adjustability of the chains that carry saddles 46 and 53.

From the foregoing, it will be appreciated that the invention achieves improved apparatus for transporting cut tissue logs and operative automatically to discard rolls of trim. The apparatus requires minimal attention by an operator, and is readily adjustable to transport logs of different diameters.

While the description and drawings are illustrative of a preferred embodiment of the invention, it will be appreciated that changes may be made without departing from the scope of the appended claims.

I claim:

1. An apparatus for transporting elongate rolls of material cut into short rolls of predetermined uniform lengths, and having end rolls of trim of different lengths therefrom to be discarded, comprising: means defining a pair of parallel paths along which a pair of cut rolls may move longitudinally; means for moving said parallel cut rolls simultaneously along said parallel paths including a plurality of movable paddle members extending between said cut rolls and so spaced in the direction of movement of the latter as to engage the confronting sides of each roll, and a plurality of movable saddle members extending into engagement with sides of said short rolls opposite the sides engaged by said paddle members, there being a pair of saddle members for each said paddle member, the recited engagement by said members being effective to support only said short rolls and not said end rolls of trim; and means accommodating gravitational removal of said end rolls of trim to discard the same, upon movement of said cut rolls along said parallel paths.

2. Apparatus of claim 1, wherein there are provided chain means for supporting and driving said paddle members and said saddle members.

3. Apparatus of claim 2, wherein each said paddle member comprises an elongate element extending transversely of its recited supporting chain means and having opposed edge portions, each said edge portion engageable with a short roll, and each said saddle member comprises an element extending transversely of its recited supporting chain means and having an arcuate portion facing said edge portions of said saddle member and engageable with a short roll on the side thereof opposite to the side of its engagement by said edge portions, the recited engagement by said paddle members and said saddle members being effective to support said short rolls.

4. Apparatus of claims 2 or 3, wherein each said chain means comprises a pair of chains, and there are provided guide means for each said pair of chains extending parallel to said travel path.

5. Apparatus of claim 4, wherein said guide means for said chains that support said saddle members are selectively adjustable frontally toward and away from said paddle members to establish the distance between said paddle and saddle members in correspondence with the diameter of the short rolls being transported.

6. Apparatus of claims 2 or 3, wherein there is provided a conveyor means for receiving said short rolls following removal of said end rolls.

7. An apparatus defining a travel path for a pair of transversely cut paper rolls having their longitudinal axes extending in the direction of said path, said rolls being laterally spaced and having end rolls of trim adapted for removal along said travel path, and conveyor means for supporting and moving individual cut rolls along said travel path, comprising: a pair of first chain means each having sections that are parallel to and adjacent opposite sides of said laterally spaced rolls; spaced curved support elements on each said chain means positioned and adapted in said chain sections to engage the side of a roll; second chain means above said cut rolls and having a section coextensive with said other recited sections of chain means; and support elements on said second chain means spaced in correspondence with said curved support elements and depending into frictional engagement with side portions of said rolls that confront one another, said support elements being sequentially engageable with cut rolls fed to said conveyor means but not engageable with said end rolls of trim, whereby said cut rolls are moved along said travel path and said end rolls of trim are permitted to drop for removal thereof.

8. Apparatus according to claim 7, further including frame structure, means defining a guide rail for each said parallel section of said first chain means, means for mounting and adjustably positioning said guide rails on said frame structure comprising a plurality of support blocks, each mounting said guide rails to said frame structure and relatively movable on said frame structure, a first means for releasably retaining each said block in an adjusted position, and a second means for adjusting and locking each said block in said adjusted position including first and second parallel screw means extending in the direction of movement of said block, said first screw means threaded through said block and abuttingly engaging said frame structure and said second screw extending with clearance through said block and threaded into said frame structure, said second screw being operative upon rotation to establish the adjusted position of said block, and said first screw being operative upon rotation to engage said side frame and lock said block in the established adjusted position thereof.

9. An apparatus for handling material of the type comprising elongate wound rolls of fibrous material cut into short rolls of predetermined uniform lengths and having end rolls of trim less than the uniform lengths to be discarded, comprising: means defining a path along which a cut roll may move longitudinally; means for moving a cut roll along said path, including a pair of chain means having parallel sections extending along said path driven longitudinally at the same speeds; support elements affixed to said chain means and spaced uniformly along said path in correspondence with the spacing of said short rolls and positioned to engage the latter, said support elements on one chain means of said pair comprising a plurality of vertically extending members disposed to engage one side of each said short roll, and the support elements on the other chain means of said pair comprising a plurality of arcuate members disposed to engage the sides of each said short roll opposite said one side, said arcuate members being provided in pairs spaced in the direction of movement along said path, and each said vertically extending member being disposed opposite the midpoint of the space between said arcuate members of each said pair, said end rolls of trim being moved along said path by said short rolls and not being engaged by said support elements; and means in said path over which said cut roll is moved while engaged as recited, and effective to remove non-engaged end rolls of trim while said short rolls are retained by said support elements.

10. Apparatus of claim 9, wherein there is included means for selectively adjusting the chain means on which said arcuate members are disposed toward or away from the section of said other chain means parallel thereto.

11. An apparatus for transporting elongate rolls of material cut into short rolls of predetermined uniform lengths, and having end rolls of trim of different lengths therefrom to be discarded, comprising: means defining a pair of parallel paths along which a pair of cut rolls may move longitudinally; means for moving said parallel cut rolls simultaneously along said parallel paths including a plurality of movable first support members extending between said cut rolls and spaced in the direction of movement of the latter so that each said first support member engages the confronting sides of a short roll, and a plurality of movable second support members each extending into engagement with a side of a short roll opposite the side engaged by a said first support member, the recited engagement by said members being effective to support only said short rolls and not said end rolls of trim; and means accommodating gravitational removal of said end rolls of trim to discard the same, upon movement of said cut rolls along said parallel paths.

12. Apparatus of claim 11, wherein there are provided chain means for supporting and driving said first and said second support members.

13. Apparatus of claim 12, wherein each said first support member comprises an elongate element extending transversely of its recited supporting chain means and having opposed edge portions, each said edge portion engageable with a short roll, and each said second support member comprises an element extending transversely of its recited supporting chain means and having an arcuate portion facing said edge portions of said first member and engageable with a short roll on the side thereof opposite to the side of its engagement by said edge portions, the recited engagement by said first members and said second members being effective to support said short rolls.

14. Apparatus of claim 12 or 13, wherein each said chain means comprises a pair of chains, and there are provided guide means for each said pair of chains extending parallel to said travel path.

15. Apparatus of claim 14, wherein said guide means for said chains that support said second support members are selectively adjustable frontally toward and away from said first support members to establish the distance between said first and second members in correspondence with the diameter of the short rolls being transported.

16. Apparatus of claim 12 or 13, wherein there is provided a conveyor means for receiving said short rolls following removal of said end rolls.

* * * * *